United States Patent [19]

Cecchini et al.

[11] Patent Number: 5,048,594

[45] Date of Patent: Sep. 17, 1991

[54] PROCESS FOR CONTROLLING CHANGE OF THROTTLING POSITION IN A SLIDING CLOSURE UNIT

[75] Inventors: Silvio Cecchini, Zürich; Walter Vetterli, Winterthur, both of Switzerland

[73] Assignee: Metacon AG, Zürich, Switzerland

[21] Appl. No.: 399,200

[22] Filed: Aug. 28, 1989

[30] Foreign Application Priority Data

Aug. 31, 1988 [EP] European Pat. Off. ..... 88114177.4

[51] Int. Cl.[5] ..... B22D 11/18

[52] U.S. Cl. ..... 164/453; 164/449

[58] Field of Search ..... 164/449, 450, 453, 136, 164/488; 222/590, 600

[56] References Cited

U.S. PATENT DOCUMENTS

| | | | |
|---|---|---|---|
| 4,077,457 | 3/1978 | Hashio et al. | 164/453 |
| 4,583,717 | 4/1986 | Hasegawa et al. | 266/44 |
| 4,597,048 | 6/1986 | Mazur et al. | 164/449 |
| 4,625,787 | 12/1986 | Haveman et al. | 164/449 |
| 4,708,193 | 11/1987 | Tinnes | 164/453 |
| 4,730,660 | 3/1988 | Tinnes et al. . | |
| 4,759,479 | 7/1988 | Tinnes . | |
| 4,770,230 | 9/1988 | Tinnes et al. | 164/483 |
| 4,890,665 | 1/1990 | Vetterli | 164/453 |

FOREIGN PATENT DOCUMENTS

| | | | |
|---|---|---|---|
| 2817115 | 10/1978 | Fed. Rep. of Germany . | |
| 3422901 | 1/1986 | Fed. Rep. of Germany . | |
| 3509932 | 10/1986 | Fed. Rep. of Germany . | |
| 2411542 | 8/1979 | France | 222/600 |
| 61-212460 | 9/1986 | Japan . | |

*Primary Examiner*—Richard K. Seidel
*Assistant Examiner*—Edward Brown
*Attorney, Agent, or Firm*—Wenderoth, Lind & Ponack

[57] ABSTRACT

A sliding plate of a sliding closure unit is moved to selected throttling positions thereof to relatively restrict the size of a discharge passage through the sliding closure unit. The control of movement of the sliding plate is achieved in a level control operation by a processor. Periodically this level control operation is interrupted and the sliding plate is moved in a throttling position change operation from one throttling position through a completely open position of the discharge passage to another throttling position, such two throttling positions employing throttling surfaces of the sliding closure unit on opposite sides of the discharge passage. The throttling position change operation includes regulating at least the throttling position at which the sliding plate is located at the conclusion of the throttling position change operation by a sequence control program included in the processor that controls the level control operation.

12 Claims, 2 Drawing Sheets

PROCESS FOR CONTROLLING CHANGE OF THROTTLING POSITION IN A SLIDING CLOSURE UNIT

BACKGROUND OF THE INVENTION

The present invention relates to a process of operating a sliding closure unit, particularly of the three-plate type, to control the discharge of molten metal from a metallurgical vessel through a discharge passage of the sliding closure unit into a mold to regulate the level of the molten metal within the mold by moving a sliding plate of the sliding closure unit to selected throttling positions thereof relatively restricting the size of the discharge passage. The present invention particularly relates to such a process wherein the movement of the sliding plate to regulate the level is controlled automatically as a function of the level in a level control operation by a processor, and wherein periodically the level control operation is automatically interrupted and the sliding plate is moved in a throttling position change operation from one throttling position through a completely open position of the discharge passage to another throttling position, such two throttling positions employing throttling surfaces of the sliding closure unit, and specifically of the sliding plate, on opposite sides of the discharge passage.

In practical molten metal casting operations, such as continuous casting operations, such a change of throttling positions, i.e. between opposite edges or surfaces of the sliding plate, results in the discharged molten metal operating on different surfaces of the sliding closure unit. As a result, erosion of the various surfaces of the sliding closure unit tends to be more uniform over the various involved surfaces, and this results in increased service life of the elements of the sliding closure unit. Furthermore, it is important that the discharge channel through the sliding closure unit be kept free of deposits that tend to form within the discharge channel, German application P 37 42 215.4 (corresponding to U.S. Pat. application Ser. No. 281,053 filed Dec. 8, 1988 and now U.S. Pat. No. 4,890,665 achieves a deposit-free discharge channel and also improved uniformity of erosion by periodically moving a sliding plate from one throttling position through a completely open position of the discharge passage to another throttling position, preferably employing opposite surfaces of the sliding closure unit. This throttling position change operation is directed by a processor while such level control operation is switched off. This achieves a "rinsing" effect tending to wash away any deposited solids and also tends to achieve uniform wear of the surfaces of the sliding closure unit that achieve throttling.

This throttling position change operation from one throttling position to an opposite throttling position however causes certain problems. This particularly is true with regard to sliding closure units used to control the discharge of molten metal into a continuous casting mold. Thus, when the sliding plate is moved from one throttling position through a completely open position of the discharge passage to another throttling position, there is an instantaneous increase in the flow of molten metal through the discharge passage. Additionally, the throttling position to which the sliding plate is moved is not always appropriate for the particular level existing at that moment in the mold. As a result of both of these factors, substantial fluctuations in the molten metal level often occur, and this can significantly influence the casting operation. Particularly, since the level control operation is interrupted during the throttling position change operation, the return to an accurate level control operation is rendered difficult.

SUMMARY OF THE INVENTION

With the above discussion in mind, it is an object of the present invention to provide an improved process of the above type, but whereby it is possible to overcome the above and other prior art disadvantages. It is a more particular object of the present invention to provide such a process wherein it is possible to periodically interrupt a level control operation and to perform a throttling position change operation from one throttling position to another opposite throttling position, but whereby the return to the level control operation is made more accurate, thereby substantially avoiding increased fluctuations in the level of molten metal within the mold, at least to a degree that ensures reliability of operation and quality of finished product.

The above objects are achieved in accordance with the present invention by the provision that the throttling position change operation comprises regulating at least the throttling position at which the sliding plate is located at the conclusion of the throttling position change operation by a sequence control program included in the processor that controls the level control operation. Specifically, the regulation is achieved such that this new throttling position at the conclusion of the throttling position change operation is controlled in a regulated or programmed manner to be that throttling position necessary to avoid a substantial fluctuation in bath level during the throttling position change operation and also to immediately enable an accurate return to the level control operation without a preliminary adjustment period by the processor. The sequence control program may be included in the processor that controls the level control operation, for example preprogrammed as part of the level control program or as a subprogram included within the processor. In this manner, the throttling position change operation can be integrated into a predetermined normal discharge operation while achieving accurate level control without the problems of the prior art. Also, the throttling position change operation can be initiated, not only at predetermined intervals, but upon the occurrence of predetermined conditions that might be detectable in a manner understood by one skilled in the art. Thus, it is possible to create any desired schedule for initiation of throttling position change operations for different molten metal discharge sequences and installations. Depending on the particular installation or discharge conditions involved, the throttling position change operation can be initiated regularly or irregularly to achieve rinsing away or flushing away of deposits formed within the discharge opening or tending to form therein, or to ensure that erosion and wear of the involved surfaces of the sliding closure unit is made uniform, or both. In other words, it is possible to design a given sequence control program for the throttling position change over operation suitable for a given casting operation and/or installation.

In accordance with a preferred feature of the present invention, prior to each throttling position change operation, at least one previous or preceding throttling position of the sliding plate is determined, and based on such determination a calculation is made of the throttling position at which the sliding plate is to be located at the conclusion of the particular throttling position change operation. In this manner it is possible to maintain within predetermined limits fluctuations of the molten metal level within the mold that otherwise would tend to occur upon commencement of the level control operation after a throttling position change operation. In other words, determining a new throttling position at the completion of the throttling position change operation as a function of a preceding throttling position tends to ensure that recommencement of the level control operation will be more accurate. This particularly is true when, in accordance with a more specific feature of this aspect of the invention, prior to each throttling position change operation at least two previously calculated throttling positions are determined, and the new throttling position at which the sliding plate is to be located at the conclusion of the throttling position change operation is calculated as the mean value of such two previously calculated throttling positions.

In accordance with a further preferred feature of the present invention, particularly suitable for molds with moderate or smaller cross sections, each throttling position change operation comprises, immediately prior to initiation thereof, moving the sliding plate in a direction from the initial throttling position to achieve increased throttling and/or immediately after completion of the throttling position change operation, moving the sliding plate in a direction from the new throttling position to achieve increased throttling. These additional or incremental movements each are by a predetermined distance, preferably less than 10 mm, and for a predetermined length of time, preferably less than 10 seconds. Further preferably, the supplemental movement from the new throttling position is by a distance and for a length of time less than the distance and length of time of movement from the initial throttling position. In other words, the throttling position change operation is initiated and/or ended by an increased throttling that is preprogrammed to be of a particular stroke length and for a particular period of time. This makes it possible to lower the level of the molten metal within the mold both before commencement and after completion of the throttling position change operation to optimally balance the increased flow of molten metal resulting from the movement of the sliding plate to the completely open position during the throttling position change operation.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
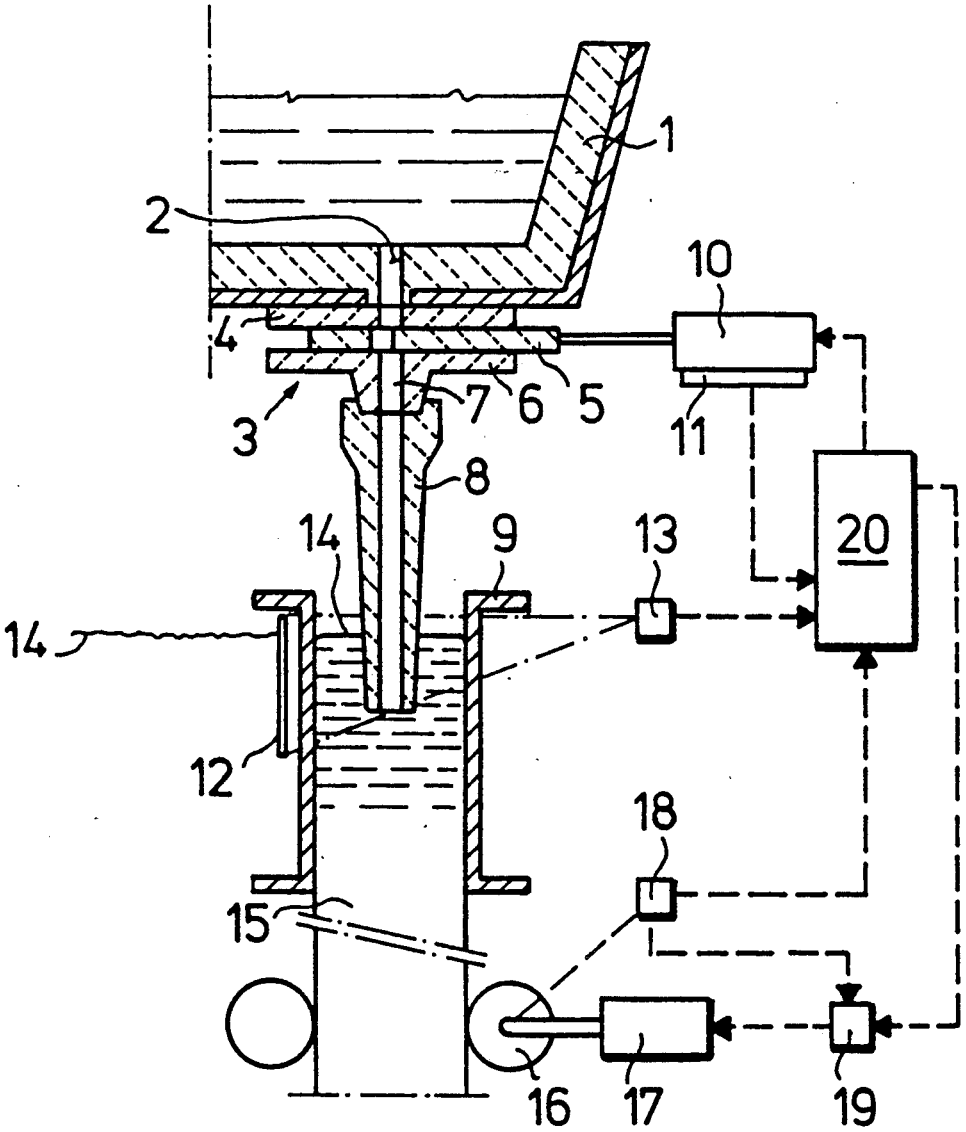
FIG. 1 is a schematic illustration of an apparatus employed in accordance with the present invention.

In FIG. 1 is shown a metallurgical vessel 1, such as an intermediate vessel or tundish, containing molten metal that is discharged through a discharge opening 2 in the bottom of the vessel. The discharge of the molten metal is controlled by a sliding closure unit 3 including upper and lower fixed or stationary plates 4, 6 with a sliding plate 5 therebetween. These are refractory plates as is known in the art, and the relative movement of sliding plate 5 throttles a discharge passage or channel 7 through the sliding closure unit. Attached to the outlet of the sliding closure unit is a casting tube 8 having a free end projecting into a continuous casting mold 9, specifically to be immersed below a desired upper level 14 of the molten metal therein. The sliding movement of plate 5 is controlled by a conventional positioner or correction device 10, and the operating position of device 10 is detected by a position measuring device or detector 11. The molten metal is discharged into mold 9 and solidifies therein as a cast strand 15 that is discharged outwardly by drive rollers 16 driven by a driver 17 by a speed controller 19. A velocity measuring device 18 transmits a velocity output signal to a processor 20, and device 18 also sends data to controller 19. The level of the molten metal in mold 9 is maintained at a desired level within a predetermined range controlled by a sender (ray emitter) 12 and a receiver 13. Processor 20 also receives and processes data from position measuring device 11 and receiver 13. Resulting control commands are sent by a controller or interface integrated into processor 20 to correction device 10 controlling the movement of sliding plate 5 and to speed controller 19. The take off speed of the cast strand 15 generally is fixed as a constant for quality reasons as would be understood by one skilled in the art. Therefore, the desired level 14 in mold 9 is controlled solely from the inflow side by means of the slide plate 5 controlling the size or cross sectional area of the throttled discharge channel 7. That is, sliding plate 5 is moved to more or less constrict the throttled discharge channel 7 to decrease or increase the amount of molten metal discharged into mold 9. Thereby, an equilibrium is established to ensure that the quantity of molten metal flowing into the mold per unit of time maintains the level 14 at the desired value, within a predetermined range. Particularly, as deposits, which inevitably tend to occur, are formed on various surfaces of the sliding closure unit, the cross sectional area of discharge passage or channel 7 tends to be restricted, such that the amount of molten metal discharged is reduced, and such that the level 14 thereby tends to decrease. This is detected in a conventional manner by elements 12, 13, thereby causing processor to operate device 10 to move sliding plate 5 in a direction tending to open.

Periodically, the level control operation is interrupted, and correction device 10 is operated to move the sliding plate 5 from one throttling position to an opposite throttling position. For example, the sliding plate 5 may assume an initial choke or throttling position D1, as shown in FIG. 3, wherein a throttling edge K1 permits controlled movements in the opening and closing directions to maintain the desired level control of the amount of molten metal flowing per unit time into mold 9. When it is desired to conduct a throttling position change operation, then sliding plate 5 is moved from the position shown in FIG. 3 through a position shown in FIG. 2, i.e. a completely open position A, to an opposite throttling position shown in FIG. 4. This throttling position D2 employs a choke or throttling edge K2 of sliding plate 5. During this throttling position change operation, the previously conducted level control operation is interrupted. Such throttling position change operation may be achieved for the purpose of ensuring uniformity of wear of the various involved surfaces of the sliding closure unit and/or to rinse away or flush away any deposits that may have formed within the discharge channel 7. The above features in and of themselves are similar to those disclosed in the above mentioned German application P 37 42 215.4 (corresponding to U.S. Pat. application Ser. No. 281,053 filed Dec. 8, 1988, now U.S. Pat. No. 4,890,665), the disclosure of which hereby is repeated and incorporated by reference.

In accordance with the present invention, the throttling position change operation is conducted in a manner such that at least the throttling position at which the sliding plate 5 is located at the conclusion of the throttling position change operation (i.e. position D2 in the above example) is regulated by a sequence control program included in processor 20 that controls the level control operation. In other words, in accordance with the present invention, the processor 20 includes a program or programs capable of achieving, not only the conventional level control, but also of regulating at least the new throttling position to which the sliding plate is located at the conclusion of the throttling position change operation.

Figure 2:
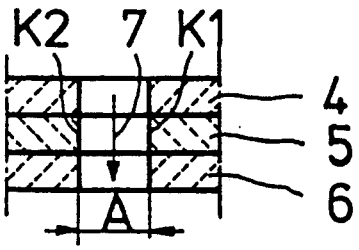
FIG. 2 is an enlarged partial view of a sliding closure unit illustrated in a completely open position during a throttling position change operation.
Figure 3:
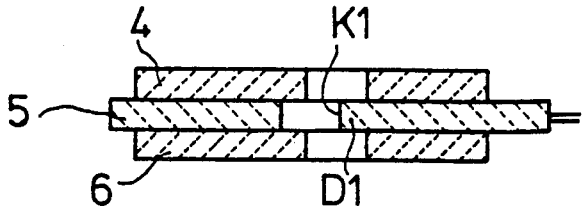
FIGS. 3 and 4 are views somewhat similar to FIG. 2 but illustrating opposite throttling positions before and after a throttling position change operation.
Figure 4:
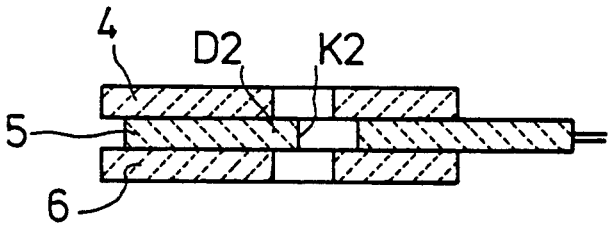
Figure 5:
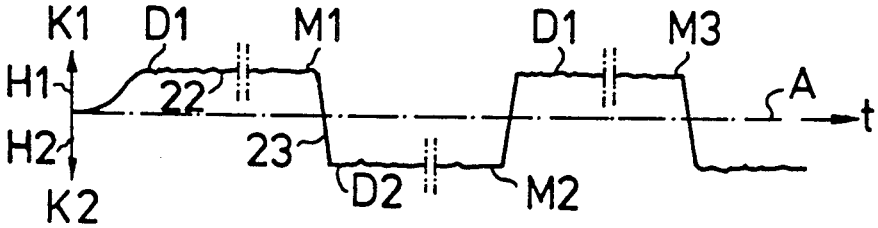
FIGS. 5 to 7 are graphs illustrating characteristic curves of sliding plate positions in opposite throttling positions in accordance with three control processes according to the present invention.

More specifically with reference to FIGS. 2–5, periodically a subprogram, for example, of processor 20 interrupts the level control operation and causes device 10 to move sliding plate 5 from the position of FIG. 3, through the fully opened position A of FIG. 2, to a new throttling position D2 shown in FIG. 4. The throttling position curve of FIG. 5 shows such periodic throttling position change operations 23 as being cyclical. Initially however, at the start of a discharge operation sliding plate 5 is moved in a stroke H1 from fully opened position A to the position D1 shown in FIG. 3 wherein edge K1 achieves throttling. In FIG. 5 the fully opened position of sliding plate 5 is shown as a horizontal line. Also, positions of the sliding plate during opposite throttling orientations and resulting from the normal level control operations are indicated by undulatory lines 22. These lines also indicate respective filling levels 14 achieved by such throttling positions. FIG. 5 also indicates such throttling positions over time t that is shown coaxially with the fully opened position A. At such time as a throttling position change operation 23 occurs, then the sliding plate 5 is moved to the opposite throttling position D2 shown in FIG. 4 (i.e. stroke H1+stroke H2). The sliding plate 5 moves through the fully opened position shown in FIG. 2, thus causing an instantaneous increased quantity of molten metal being discharged into mold 9. At the completion of this throttling position change operation, the new throttling position D2 must be corrected or changed with respect to the initial throttling position D1 to compensate for such increased flow during the fully opened position. A correction signal is sent to device 10 by processor 20 which, prior to the throttling position change operation and prior to having interrupted the level control operation, receives directly from position measuring device or detector 11 a signal relating to the instantaneous position of actuator or correction device 10 and stores such signal or data. Then the processor 20, and specifically a sequence control program thereof, calculates from such data the new throttling position D2 at which the sliding plate is to be located at the conclusion of the throttling position change operation. In a particularly preferred embodiment of this aspect of the invention, the processor or the sequence control program thereof calculates from at least two previously calculated throttling positions M1, M2, from signals or data previously determined by device 11, a mean value M3 of the new throttling position D2 of plate 5. This is one example of a manner in which the precise location of throttling edge K2 may be predetermined based on previous throttling positions detected by device 11 and stored in processor 20 or a sequence control program, such as a subprogram, thereof.

Figure 6:
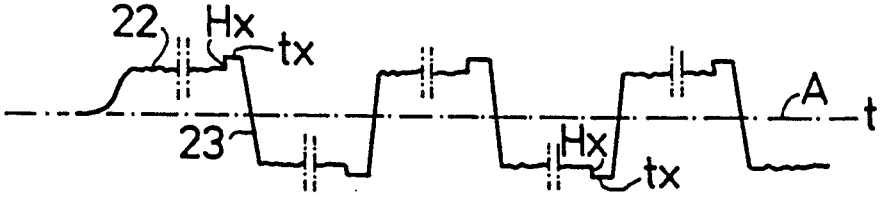

In accordance with a further feature of the present invention, particularly illustrated in FIG. 6, the throttling position change operation comprises, immediately prior to initiation thereof, moving sliding plate 5 in a direction from the initial throttling position D1 to achieve increased throttling. In other words, the processor 20 or the sequence control program thereof is designed to interrupt the normal level control operation and to increase the throttling by a slight amount Hx for a short period of time tx. This short increased throttling essentially tends to achieve a lowering of the level 14 to compensate for the additional inflow of molten metal resulting from movement to the fully opened position A. This is done in a manner to compensate for the expected additional inflow of molten metal in a given installation and operation.

Figure 8:
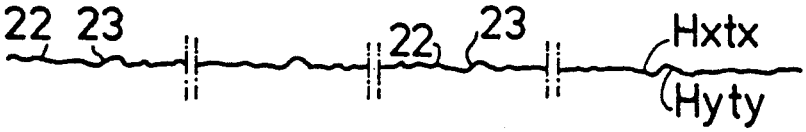
FIG. 8 is a graph indicating a curve of filling level characteristics achieved in the control process of FIG. 7.
Figure 7:
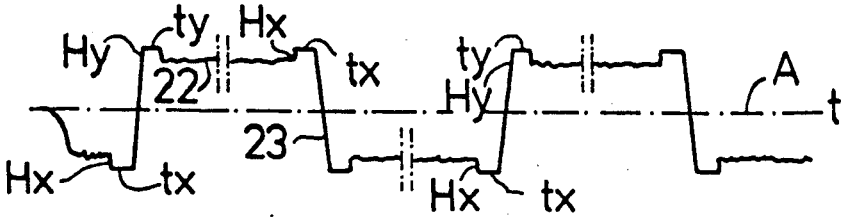

FIG. 7 shows a further feature of this aspect of the present invention wherein in addition to the supplemental throttling illustrated in FIG. 6, the throttling position change operation also includes, immediately after completion of the throttling position change operation, a movement of sliding plate 5 in a direction from the new throttling position D2 to achieve increased throttling. This increased throttling is by an amount Hy for a period of time ty. This increased throttling at the completion of a throttling position change operation fulfills the purpose of rapidly achieving an equilibrium of the molten metal level to achieve as quickly as possible the desired level 14. When additional throttling is achieved both before and after the throttling position change operation as indicated in FIG. 7, then the initial throttling distance Hx and the initial short period of time tx will be greater than the final throttling distance Hy and short time period ty. Both of these additional throttling strokes and time periods are preprogrammed into the processor 20 or the sequence control program thereof. FIG. 8 indicates schematically the effect on the melt level of the additional throttling achieved at the beginning and end of throttling position change operations 23.

The number of and timing between throttling position change operations for a given casting operation would be understood by one skilled in the art from a consideration of the present disclosure. The factors initiating a particular throttling position change operation, i.e. regularly or irregularly, also would be understood by one skilled in the art. These factors would be considered and adapted to a particular sliding closure unit 3 and/or to particular discharged conditions in a particular casting system, such as a continuous casting plant. Generally, it is assumed that more precise control may be achieved by the embodiment of FIGS. 7 and 8 and that this embodiment would be more beneficial with a mold having a relatively small cross section.

Furthermore, one skilled in the art readily would understand how to us conventional programming techniques to provide processor 20 with the above discussed sequence control program to achieve the functions and operations disclosed herein.

Although the present invention has been described and illustrated with respect to preferred features thereof, it is to be understood that various modifications and changes may be made to the specifically described and illustrated features without departing from the scope of the present invention.

We claim:

1. A process of operating a sliding closure unit to control the discharge of molten metal from a metallurgical vessel through a discharge passage of said sliding closure unit into a mold to regulate the level of said molten metal within said mold, said process comprising:

moving a sliding plate of said sliding closure unit to selected throttling positions thereof relatively restricting the size of said discharge passage;

controlling the movement of said sliding plate to regulate said level as a function of said level in a level control operation by a processor; and periodically interrupting said level control operation and moving said sliding plate in a throttling position change operation from one throttling position through a completely open position of said discharge passage to another throttling position, such two throttling positions employing throttling surfaces of said sliding closure unit on opposite sides of said discharge passage, said throttling position change operation comprising regulating at least said throttling position at which said sliding plate is located at the conclusion of said throttling position change operation by a sequence control program included in said processor controlling said level control operation, said regulating comprising, prior to each said throttling position change operation, determining at least one preceding throttling position of said sliding plate, and based on such determination calculating said throttling position at which said sliding plate is to be located at the conclusion of said each throttling position change operation.

2. The process claimed in claim 1, comprising determining at least two previously calculated throttling positions, and calculating said throttling position at which said sliding plate is to be located at the conclusion of said each throttling position change operation as the mean value of said at least two previously calculated throttling positions.

3. The process claimed in claim 1, wherein each said throttling position change operation comprises, immediately prior to initiation thereof, moving said sliding plate in a direction from said one throttling position to achieve increased throttling.

4. The process claimed in claim 3, wherein said moving from said one throttling position to achieve increased throttling is by a predetermined distance and for a predetermined length of time.

5. The process claimed in claim 4, wherein said predetermined distance is less than 10 mm, and said predetermined length of time is less than 10 seconds.

6. The process claimed in claim 3, wherein each said throttling position change operation further comprises, immediately after completion thereof, moving said sliding plate in a direction from said another throttling position to achieve increased throttling.

7. The process claimed in claim 6, wherein said moving from said another throttling position to achieve increased throttling is by a predetermined distance and for a predetermined length of time.

8. The process claimed in claim 7, wherein said predetermined distance is less than 10 mm, and said predetermined length of time is less than 10 seconds.

9. The process claimed in claim 6, wherein said moving from said another throttling position is by a distance and for a length of time less than the distance and length of time of movement of said moving from said one throttling position.

10. The process claimed in claim 1, wherein each said throttling position change operation comprises, immediately after completion thereof, moving said sliding plate in a direction from said another throttling position to achieve increased throttling.

11. The process claimed in claim 10, wherein said moving from said another throttling position to achieve increased throttling is by a predetermined distance and for a predetermined length of time.

12. The process claimed in claim 11, wherein said predetermined distance is less than 10 mm, and said predetermined length of time is less than 10 seconds.

* * * * *